US007841062B2

(12) United States Patent
Bergue et al.

(10) Patent No.: US 7,841,062 B2
(45) Date of Patent: Nov. 30, 2010

(54) METHOD FOR WORKING A METAL SLUG, SLEEVE FOR IMPLEMENTING THE METHOD

(75) Inventors: Jean-Pierre Bergue, Soisy Sous Montmorency (FR); Gilbert Leconte, Asnieres sur Seine (FR)

(73) Assignee: Snecma, Paris (FR)

( * ) Notice: Subject to any disclaimer, the term of this patent is extended or adjusted under 35 U.S.C. 154(b) by 1319 days.

(21) Appl. No.: 11/357,033

(22) Filed: Feb. 21, 2006

(65) Prior Publication Data

US 2006/0185415 A1 Aug. 24, 2006

(30) Foreign Application Priority Data

Feb. 21, 2005 (FR) ..... 05 50480

(51) Int. Cl.
*B23P 25/00* (2006.01)
*B21C 23/24* (2006.01)

(52) U.S. Cl. ..... 29/458; 72/347

(58) Field of Classification Search ..... 29/458, 29/530, 527.7, 527.6, 527.5, 527.4; 72/347, 72/352, 46, 359, 342.8, 358, 377, 356, 478, 72/339, 342.7

See application file for complete search history.

(56) References Cited

U.S. PATENT DOCUMENTS 2,755,545 A 7/1956 Moore
7,454,941 B2 * 11/2008 Bergue et al. ..... 72/359

FOREIGN PATENT DOCUMENTS

EP 0 841 105 A2 5/1998

OTHER PUBLICATIONS

U.S. Appl. No. 11/260,143, filed Oct. 28, 2005, Bergue, et al.

* cited by examiner

*Primary Examiner*—John C Hong
(74) *Attorney, Agent, or Firm*—Oblon, Spivak, McClelland, Maier & Neustadt, L.L.P.

(57) ABSTRACT

An upsetting method for working a metal slug of cylindrical shape and provided with a coating is disclosed. The slug is placed, lengthwise, in a sleeve the internal wall of which leaves a space with respect to the lateral surface of the slug, the slug and sleeve assembly is placed in an upsetting container, and an upsetting force is exerted on the slug on at least one of its transverse surfaces until a determined slenderness ratio has been obtained, and the slug is separated from the sleeve. The slug is upset continuously but only the slug is upset because of the space formed by the internal wall of the sleeve. The material of the sleeve, for example made of steel, is not welded or seized to the slug, which means that it need not be machined in order to separate the two after the operation.

14 Claims, 1 Drawing Sheet

METHOD FOR WORKING A METAL SLUG, SLEEVE FOR IMPLEMENTING THE METHOD

BACKGROUND OF THE INVENTION

1. Field Of The Invention

The invention relates to a method of upsetting the working of a metal slug, to a sleeve for implementing the method and to a sleeve and lid assembly for implementing the method.

2. Description Of The Related Art

Metal forgings are generally obtained by forging slugs, or billets, which are part-finished rough blanks of metal parts, generally in the form of bars, used as basic elements for forging the part that is to be obtained, their volume corresponding to the volume of the latter increased by the volume lost during forging. For example, in a jet engine, the fan discs or the compressor drums are obtained by forging metal slugs.

The invention applies particularly to the working of metal slugs resulting from powder metallurgy, but relates more generally to the working of metal slugs. It is above all recognized for the working of materials that are difficult to forge, particularly as a result of small acceptable temperature ranges.

Metal slugs originating from powder metallurgy are generally obtained by extruding a container containing the powdered material. During the extrusion, the container is forced, by a press, to pass through an orifice of a cross section smaller than its own, during which operation the material forms a dense bar. Machining the container enveloping the material—and to which it has become welded during the extrusion operation—yields the slug ready for working. Current constraints dictate a maximum diameter smaller than 300 mm, typically of the order of 230 mm, for a metal slug obtained from powder metallurgy.

Furthermore, in the field of aeronautical engineering, the safety criteria are very strict and dictate checks at all stages of manufacture. The slugs have, in particular, to be inspected, for example using ultrasound, in order to detect whether any inclusions or defects are present in the metal, as a result of cracks that have appeared during forging and possibly breaks in the finished part. The requirements governing the maximum permissible defect size in the billets as dictated by the engine manufacturers are becoming increasingly strict. Slug suppliers therefore limit the diameter of the slugs in order to be able to perform quality control using ultrasound and meet the criteria dictated by the constructors. Typically, once again, this diameter is smaller than 300 mm, for nickel-based or cobalt-based metal slugs originating from powder metallurgy.

If the finished parts of the jet engine are of large volume, then the slugs have to have a high slenderness ratio, typically in excess of 2.8, often of the order of 7 to 10, in order to compensate for their small cross section.

The term "working" is intended to cover hot deformation of a metal part in order to obtain an increase in its diameter and reduction in its length, for equal volumes. The working may be done by upsetting, that is to say by applying stress in lengthwise direction of the metal slug.

In the case of metal slugs originating from powder metallurgy, a slenderness ratio in excess of 2.8 means continuous upsetting of the slugs in order to work them so as to obtain slugs in which the ratio of length to diameter is small. The ratio is brought down to a value at which they can be forged, stamped or alternatively upset again without being contained laterally, without the risk of buckling or of imperfections being created within the fibre of the metal.

Contained upsetting means upsetting in which the slug is laterally protected, none of its surfaces being in contact with the open air. The alloys resulting from powder metallurgy require the most isothermal upsetting possible, it being typically necessary for the temperature not to drop by more than 50 or 100° C. during upsetting, otherwise deep cracks or tears will appear in the material. The operating temperature lies between the plastic deformation temperature and the melting point of the alloy, thus allowing the alloy to be forged, and is limited by a maximum value defined to ensure control over the microstructure of the alloy. Furthermore, the diameter of the worked mass must not be too small, otherwise imperfections may be created in the material. It needs to be arranged such that the slenderness ratio is below 2.8.

To achieve this, the prior art teaches cladding the slug in a steel tube, which increases its diameter and affords thermal protection. The slug and tube assembly is then upset in the open air, because it has sufficient diameter. During such upsetting, the slug and the steel tube will establish a metallic bond between them, comparable to a seized connection. It is therefore necessary, after upsetting, to machine the assembly, for example machining it on a lathe, so as to remove the steel in order to find a slug that contains only the alloy originating from the powder metallurgy. Firstly, such machining is expensive, and secondly leads to a loss in slug material. This loss of material is all the greater since, in general, the interface between the slug and the tube is relatively irregular, which means that more machining has to be done as a safety measure.

It would be desirable not to use a steel sheath. However, in such a case, it would be necessary to use very hot tooling, which would cause cracks and fissures in the slug, which would then have to be eliminated, in so far as they were accessible, by grinding.

BRIEF SUMMARY OF THE INVENTION

The invention aims to alleviate these disadvantages.

To this end, the invention relates to an upsetting method for working a metal slug of cylindrical shape and provided with a coating, characterized in that the slug is placed, lengthwise, in a sleeve the internal wall of which leaves a space with respect to the lateral surface of the slug, the slug and sleeve assembly is placed in an upsetting container, and upsetting force is exerted on the slug on at least one of its transverse surfaces until a determined slenderness ratio has been obtained, and the slug is separated from the sleeve.

By virtue of the invention, the slug is upset continuously but only the slug is upset, this being permitted because of the space formed by the internal wall of the sleeve. By virtue of the coating and the difference in cross section, the material of the sleeve, for example made of steel, is not welded or seized to the slug, which means that it need not be machined in order to separate the two after the operation. Thus there is no loss of slug material nor is there any additional cost associated with subsequent machining. The upset slug obtained thus has a very good surface finish and a very high metallurgical quality.

Advantageously, the slug is of cylindrical shape.

Obtaining an upset slug of cylindrical shape is advantageous because it makes subsequent forging, upsetting or stamping easier.

The invention also relates, for the implementation of the method described hereinabove, to the use of a sleeve of cylindrical shape intended to accommodate a metal slug, comprising an end wall from which there rises a cylindrical side wall, the end wall comprising an imprint for centering and preforming a slug.

The invention also relates to a sleeve and lid assembly comprising a sleeve as described hereinabove and a lid in the form of a plate of circular shape, the cross section of which is more or less equal to the internal cross section of the sleeve, very slightly smaller.

The invention applies particularly well to the upsetting of slugs made of alloy resulting from powder metallurgy, but also applies more generally to the upsetting of any metal slug.

BRIEF DESCRIPTION OF THE DRAWINGS

The invention will be better understood with the aid of the following description of the preferred embodiment of the invention, with reference to the attached plates in which.

DETAILED DESCRIPTION OF THE INVENTION

Figure 1:
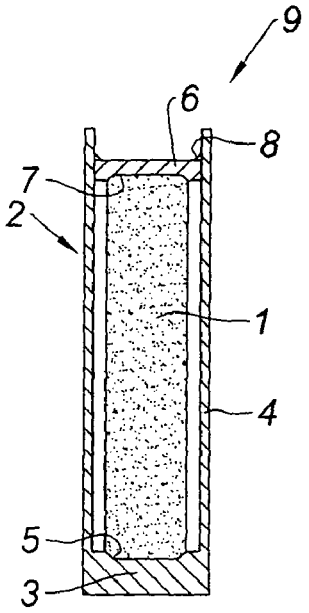
FIG. 1 depicts a schematic sectional view of a metal slug housed in the sleeve of the invention.
Figure 2:
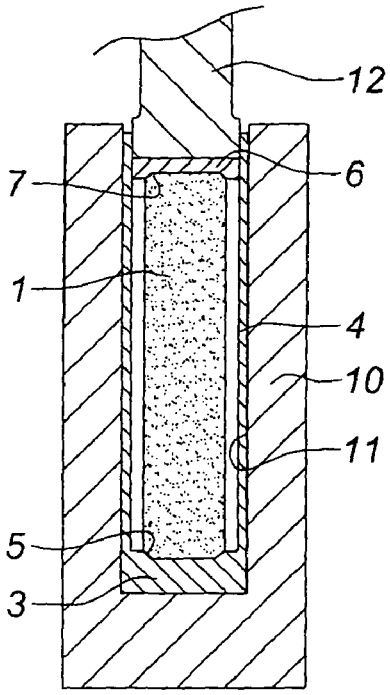
FIG. 2 depicts a schematic sectional view of the slug and of the sleeve of FIG. 1, both housed in an upsetting container before the slug is upset.

The object of the method of the invention is to upset a metal slug 1, in this instance a slug 1 made of a nickel-based or cobalt-based alloy obtaining using powder metallurgy. This slug 1 is of cylindrical shape. It has a given cross section and a given length. Its slenderness ratio, that is to say the ratio of its length to the diameter of its cross section in this instance is in excess of 2.8 and may be of the order of 10 or higher. The slug 1 is coated, by vitrification, with a coat of enamel.

The slug 1 is housed in a sleeve 2 of cylindrical shape. This sleeve 2 comprises an end wall 3 from which there rises a cylindrical side wall 4 of relatively small thickness by comparison with the diameter of the sleeve. The cross section of the cylinder formed by the internal surface of the side wall 4 is greater than the cross section of the slug 1. In this instance, in the case of a slug 1 with a cross-sectional diameter of about 235 mm, the internal cross-sectional diameter of the sleeve 2 is approximately 300 mm while the thickness of its side wall 4 is approximately 20 mm. The sleeve 2 in this instance comprises, and here consists of a mild steel, which is fairly strong for the application for which it is intended. Such a steel is inexpensive, which may be preferable given the fact that the sleeve 2 is intended to be destroyed. Furthermore, it could be recycled, once the sleeve 2 has been destroyed. In the particular case considered, the sleeve 2 is formed by welding its cylindrical side wall 4, in this instance made of mild steel, to the end wall 3, in this instance made of a nickel alloy.

The slug 1 is inserted in the sleeve 2 via its open end. The end wall 3 of the sleeve 2 comprises an imprint 5 for centering the slug 1. A lid 6 in the form of a plate of circular shape, the cross section of which is more or less equal to the internal cross section of the sleeve 2, very slightly smaller, is inserted via the open end of the sleeve 2 to cover the slug 1. The lid 6 here is made of a nickel alloy. This lid 6 also comprises, on its underside, that is to say on its surface in contact with the slug 1, an imprint 7 for centering the slug 1. The lid 6 is then held in position by a weld 8 made between its top surface and the internal wall of the sleeve 2. This weld 8 is not designed to be very strong because its function is merely to hold the lid in position rather than to seal it; this weld may also be in the form of spot welds. The assembly 9 comprising the slug 1, the sleeve 2 and the lid 6 is therefore held together, the weld 8 being breakable through application of sufficient force. This assembly 9 is ready to be used and can be temporarily stored in this state. It can also be handled.

Prior to the upsetting operation, the assembly 9 is placed in an oven in which it is heated to the temperature required for upsetting. Determining this temperature makes it possible to control the deformation of the material and the microstructure of the alloy of the slug 1 during the upsetting operation described hereinafter. In this particular instance, for a slug 1 made of nickel-based alloy, this temperature may range between 900° C. and 1200° C. and for example be of the order of 1100° C.

The assembly 9 is then placed in an upsetting container 10 made of steel and comprising a cylindrical housing 11 the cross section of which corresponds to the external cross section of the sleeve 2. During handling, the mechanical strength of the steel of the sleeve 2 will admittedly have reduced on account of the temperature, but still remains sufficient for the geometry to be maintained. The upsetting container 10 has also been preheated, in this instance to a temperature of the order of 400 to 500° C. It is installed on a hydraulic press comprising a punch 12 which is set to bear against the upper surface of the lid 6 of the assembly 9. This punch 12 is able to move in vertical translation, driven by the mobile upper platen of the hydraulic press. Its area of contact with the lid 6 is identical to, or of slightly smaller dimensions than, the cross-sectional area of this lid.

The operation of upsetting the slug 1 is then carried out. The punch 12 is driven by a conventional hydraulic mechanism of the hydraulic press platen to be lowered at a determined rate and thus exert stress on the slug 1, in its lengthwise direction, via the lid 6 which descends with the punch 12, the weld 8 having been broken by the stress exerted by the punch 12. Since the slug 1 is at a temperature higher than its plastic deformation temperature (but below its melting point), plastic deformation of the material of the slug 1 ensues, this being manifested by a reduction in its length and an increase in its cross section. The rate of descent of the punch 12 is determined, in collaboration with the choice of the temperature of the material, in such a way as to control the deformation of the material and the change in its microstructure. In this particular instance, for a nickel-based alloy, it is chosen to be of the order of 10 mm/sec. This rate may vary during the course of the upsetting operation.

During the upsetting, since the diameter of the lid 6 is slightly smaller than the internal diameter of the sleeve 2, the air filling the gap between the slug 1 and the internal wall of the sleeve 2 is expelled via the gap between the lid 6 and the sleeve 2.

The enamel with which the slug 1 is coated performs three functions: lubricating the device; protecting against oxidation; and forming protection between the slug 1 and the sleeve 2. Thus, during upsetting, the enamel forms a pasty interface which, at the end of upsetting, when the walls of the slug 1 come into contact with the internal wall of the sleeve 2, prevents the slug 1 from welding itself to this wall. Furthermore, the same function is performed throughout the upsetting operation at the lid 6 and at the end wall 3 of the sleeve 2.

It will be noted that, unlike the methods of the prior art, only the slug 1 is upset here. The sleeve 2 is not deformed by the operation and performs a function of containing the slug 1 and of acting as a thermal barrier or buffer between the slug 1 and the upsetting container 10. Thus, even if the temperature of the upsetting container 10 decreases, the temperature of the slug 1 is not appreciably affected thereby. Furthermore, the slug 1 is kept centred by the imprints 5, 7 of the end wall 3 of the sleeve 2 and of the underside of the lid 6, respectively. These imprints 5, 7 can thus perform a function of preforming the slug 1 and thus be designed to preform the ends of the slug 1 according to the shape that is to be given to the finished part, through a further upsetting and/or stamping and/or forging operation on the slug 1, once this upsetting operation has been completed.

Figure 3:
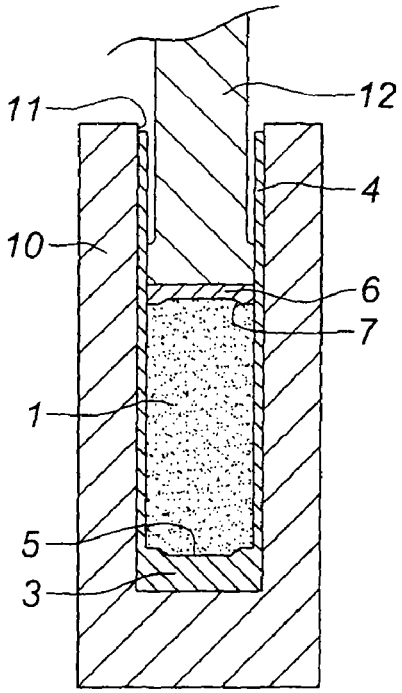
FIG. 3 depicts a schematic sectional view of the slug and of the sleeve of FIG. 1, both housed in an upsetting container, at the end of the upsetting of the slug.

The upsetting operation is halted when a certain force is reached on the slug 1. The slug 1 then fills practically the entire cross section of the sleeve 2, its cross section having increased and its length having reduced accordingly, since there is no change in volume. In this situation, the punch 12 is in the lowered position as can be seen in FIG. 3. The slug 1 has indeed been worked by upsetting.

At the end of upsetting, the punch 12 can sustain additional pressure on the assembly, for example for 10 seconds or so, in order to ensure that the geometry of the worked slug is correct, particularly that the material is correctly filling the entire housing 11, especially the corners thereof.

Figure 4:
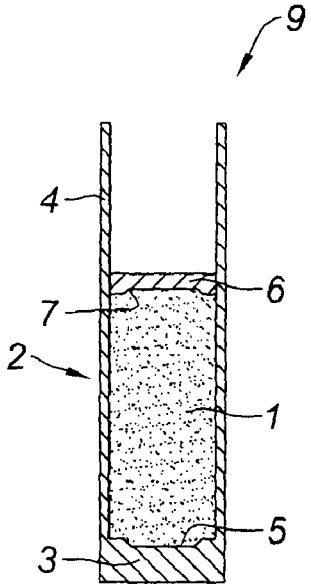
FIG. 4 depicts a schematic sectional view of the slug and of the sleeve of FIG. 1 after the slug has been upset.

With reference to FIG. 4, the assembly 9 comprising the slug 1, the sleeve 2 and the lid 6, in the lowered position, with the slug 1 upset, is then extracted from the upsetting container 10. This operation is performed in an entirely conventional way. To this end, an actuator may, for example, form the end wall of the housing 11 of the upsetting container 10 and be driven upwards after the upsetting operation, with the punch 12 having previously been driven upwards, so that the assembly 9 can be extracted from the housing 11. Any other method of extraction is conceivable.

The assembly 9 is then cooled. To do this, it may simply be left to cool in the open air. Once a desired temperature has been reached, the slug 1 is removed from the sleeve 2. Since these two elements have not welded themselves together, this operation is very easy. For example, once the upper portion of the sleeve 2 has been cut off above the lid 6, it is possible to make two opposed longitudinal slots, by milling, along the side wall of the sleeve 2, insert a wedge into this slot in order to separate the two wall portions from one another and thus be able to extract the slug 1 from the sleeve 2. The slot may also be made at the level of the lid 6 or of the end wall 3 of the sleeve 2, in order to remove one of these ends it then being possible for the slug 1 to be slid freely in its lengthwise direction and extracted from the sleeve 2 thus opened. However, such a slot is not generally needed because, on account of the enamel, the slug 1 is secured neither to the end wall 3 nor to the lid 6.

The slug 1 is just then processed in order to remove the remains of its enamel coating. This treatment may be a mechanical treatment, for example by shot peening or steel wire, or chemical treatment, for example using a soda bath.

The slug 1 thus worked by upsetting may either be upset again using the same method if necessary, or upset without being contained, stamped or forged, or may undergo several of these operations in order to obtain the finished part.

It may be noted that separating the slug 1 from the sleeve 2 is made very much easier here by the difference in the values of the coefficients of expansion of the materials employed. Thus, during cooling, the volume of a slug 1 made of nickel alloy will reduce more than that of a sleeve 2 made of steel, thus creating a gap between the two and making them easier to separate.

By virtue of the method of the invention, the slug is indeed upset in a contained manner, this being advantageous in certain applications, for example when upsetting a slug of relatively small diameter originating from powder metallurgy. Only the slug is upset and this is easily removed from its protective sleeve at the end of the method. The worked slug is obtained without any loss of material or any additional cost associated with subsequent machining and thus exhibits a very good surface finish and a very good metallurgical quality. Various cross sections of slug can be obtained by adapting the cross section of the sleeve and of the upsetting container.

The invention claimed is:

1. An upsetting method for working a metal slug of cylindrical shape which is provided with a coating, comprising:

placing the slug, lengthwise, in a sleeve to form an assembly, a cross section area of the sleeve being greater than a cross section area of the slug so as to provide a space between a side wall of the sleeve and a lateral surface of the slug;

placing the assembly in an upsetting container;

exerting an upsetting force on the slug on at least one transverse surface of the slug until a determined slenderness ratio has been obtained;

extracting the assembly from the upsetting container; and separating the slug the sleeve.

2. The method according to claim 1, wherein the slug has an initial slenderness ratio in excess of 2.8.

3. The method according to claim 1, wherein the slug is coated with an enamel, forming a pasty state during upsetting.

4. The method according to claim 1, wherein the sleeve comprises an end wall, and prior to placing the assembly in the container, a lid is placed in the sleeve over the free end of the slug.

5. The method according to claim 4, wherein the lid is welded to the sleeve by a weld that holds the lid in position and can be broken by the upsetting operation.

6. The method according to claim 4, wherein the end wall and the lid each comprise an imprint for centering and preforming the slug.

7. The method according to claim 1, wherein separating the slug from the sleeve includes milling at least one slot in one of the walls of the sleeve.

8. The method according to claim 1, comprising heating the assembly, prior to placing the assembly in the upsetting container.

9. The method according to claim 1, wherein the upsetting force is exerted by a punch of a hydraulic press on which the upsetting container is mounted.

10. The method according to claim 9, wherein a speed of the punch follows a law in which its values are of the order of 10 mm/sec and, at the end of exerting the upsetting force, the punch sustains pressure on the slug.

11. The method according to claim 1, wherein the material of the sleeve comprises a mild steel.

12. The method according to claim 1, wherein the slug originates from powder metallurgy.

13. A sleeve for implementing the method of claim 1, of cylindrical shape, intended to accommodate a metal slug, comprising:

an end wall from which there rises a cylindrical side wall, wherein the end wall includes an imprint for centering and preforming a slug.

14. The method according to claim 1, wherein the sleeve is cylindrical, and a cross-sectional diameter of the slug is less than an internal cross-sectional diameter of the sleeve.

* * * * *